US005461950A

United States Patent [19]

Iwinski

[11] Patent Number: 5,461,950

[45] Date of Patent: Oct. 31, 1995

[54] T-SHAPED REVERSIBLE RATCHET TOOL

[75] Inventor: Dean J. Iwinski, Muskego, Wis.

[73] Assignee: Snap-on Incorporated, Kenosha, Wis.

[21] Appl. No.: 232,607

[22] Filed: Apr. 25, 1994

[51] Int. Cl.[6] ..... B25B 13/46

[52] U.S. Cl. ..... 81/61

[58] Field of Search ..... 80/59.1, 60, 61

[56] References Cited

U.S. PATENT DOCUMENTS

| | | | |
|---|---|---|---|
| 106,036 | 8/1870 | Dickson . | |
| 373,872 | 11/1887 | Williams . | |
| 827,846 | 8/1906 | Bowser et al. | 81/61 |
| 1,807,134 | 5/1931 | Pfauser | 81/61 |
| 2,507,455 | 5/1950 | Ott . | |
| 2,564,356 | 8/1951 | Dianda . | |
| 3,638,519 | 2/1972 | Rebold . | |
| 3,672,419 | 6/1972 | Fischer . | |
| 3,742,787 | 7/1973 | Whiteford . | |
| 3,958,469 | 5/1976 | Meese . | |
| 4,210,185 | 7/1980 | Acevedo . | |
| 4,799,832 | 1/1989 | Abbott . | |
| 4,926,721 | 5/1990 | Hsiao . | |
| 5,069,091 | 12/1991 | Bramsiepe et al. . | |

*Primary Examiner*—James G. Smith
*Attorney, Agent, or Firm*—Emrich & Dithmar

[57] ABSTRACT

A generally T-shaped ratchet tool includes an oblong handle containing ratchet mechanism and a shaft engageable with the ratchet mechanism and extending axially therefrom transversely of the handle for coupling to a driven member. The handle housing is formed of two identical plastic halves ultrasonically welded together for cooperation to define therein a cavity formation in which is disposed a ratchet wheel and a pawl, with the ratchet wheel being rotatable relative to the housing in only one direction about an axis. In a first embodiment a shaft is matingly engaged in a passage through the ratchet wheel and is retained therein for axial movement between first and second use positions, respectively projecting through openings at opposite sides of the housing. Detent means holds the shaft in each of its use positions and retains the shaft in engagement with the driven member. In a second embodiment a removable shaft has an engagement portion engageable in the passage of the ratchet wheel from either side of the housing, being held in place by detent structure. The ratchet wheel passage and mating shaft may be either square or hexagonal in transverse cross section, and the shaft may comprise a square driver or may define a bit-receiving socket.

4 Claims, 4 Drawing Sheets

Fig. 9
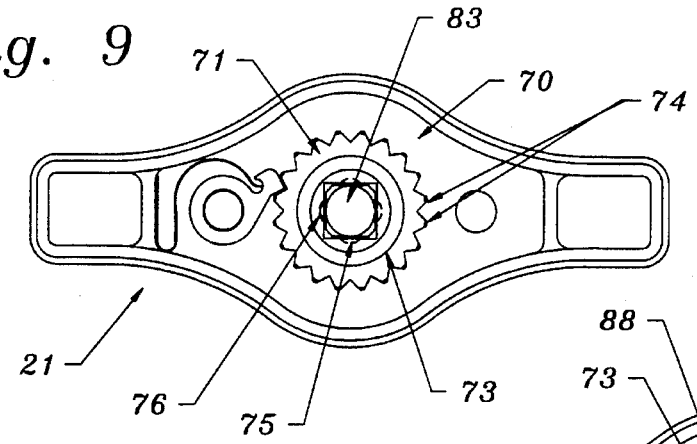
Fig. 11
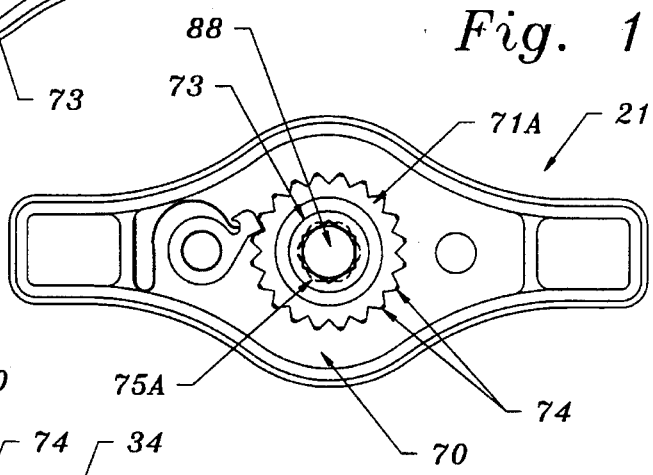
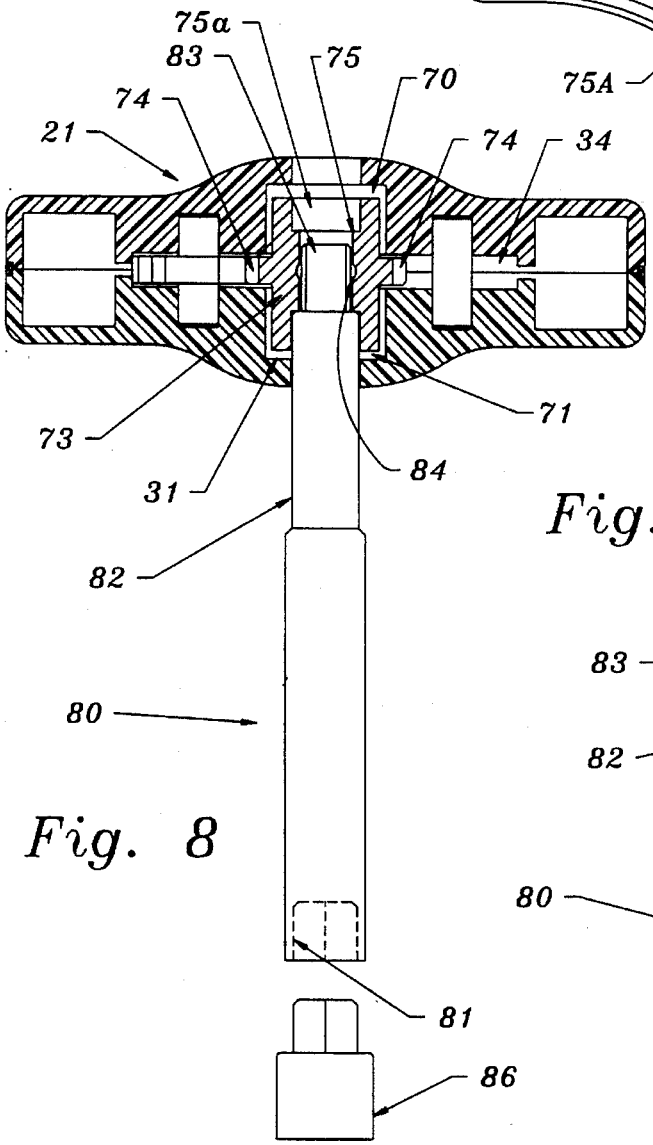
Fig. 8
Fig. 12
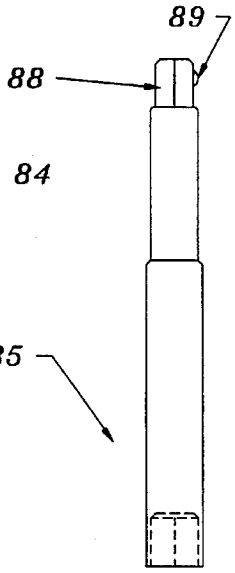
Fig. 10
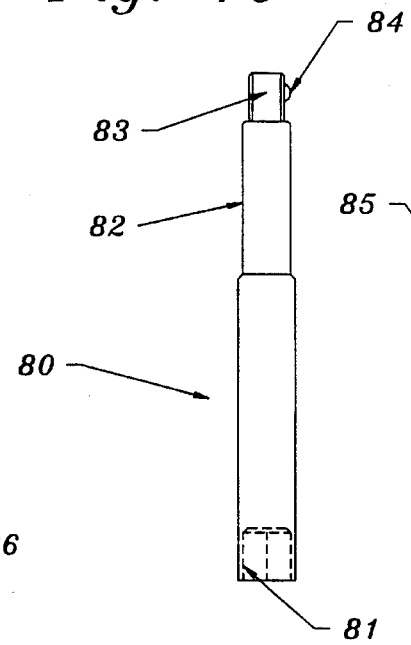

T-SHAPED REVERSIBLE RATCHET TOOL

BACKGROUND OF THE INVENTION

1. Field of the Invention

The present invention relates to driving tools of the type incorporating one-way clutch or ratchet mechanisms engageable with an associated shaft. The invention relates particularly to such ratchet tools in which the direction of rotation of the shaft can be changed by changing its orientation relative to the ratchet mechanism.

2. Description of the Prior Art

It is known to provide ratcheting hand tools with a one-way clutch or ratchet mechanism engageable with an associated shaft or the like for rotating it in either of two different directions. In one type of such tool the reversing of direction is achieved by the use of a removable shaft which can be inserted into the ratchet mechanism from either side thereof. In another type of reversing ratchet tool, a shaft is trapped in engagement with the ratchet mechanism and is axially movable between first and second use positions, respectively protruding from opposite sides of the tool.

However, these prior art mechanisms are of relatively complex construction and are, therefore, expensive to manufacture and assemble, utilizing a multiplicity of different parts. Also, the two different types of reversing arrangements mentioned above have been of altogether different construction with no commonality of parts.

SUMMARY OF THE INVENTION

It is a general object of this invention to provide an improved ratchet tool which is adapted to rotate a driven shaft in either of two opposite directions, and which avoids the disadvantages of prior ratchet tools.

An important feature of the invention is the provision of a ratchet tool of the type set forth, which is of simple and economical construction.

A further feature of the invention is the provision of a ratchet tool of the type set forth, which uses a minimal number of unique parts.

Still another feature of the invention is the provision of different types of ratchet tools which use interchangeable parts.

These and other features of the invention are attained by providing a ratchet tool comprising: an oblong handle housing including two substantially identical plastic housing members each having an inner side and an outer side, the housing members being fixedly secured together with their inner sides in abutting mating relationship, the housing members cooperating to define a cavity formation in the handle housing, and ratchet mechanism disposed in the cavity formation and including a ratchet wheel rotatable in only one direction relative to the handle housing about an axis extending transversely of the handle housing, the ratchet wheel having an axial passage therethrough polygonal in transverse cross section, the handle housing having two apertures respectively formed in the housing members coaxial with the axis and communicating with the passage for receiving an associated shaft shaped for mating engagement in the passage.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 8 is a view in vertical section taken along the line 8—8 in FIG. 7;

FIG. 9 is a top plan view of the ratchet tool of FIG. 8 with the upper housing member removed;

FIG. 10 is a reduced side elevational view of the shaft of the ratchet tool of FIG. 8;

FIG. 11 is a view similar to FIG. 9 illustrating a modified form of the ratchet tool with a hexagonal shaft; and FIG. 12 is a reduced side elevational view of the hexagonal shaft of the ratchet tool of FIG. 11.

DESCRIPTION OF THE PREFERRED EMBODIMENTS

Figure 1:
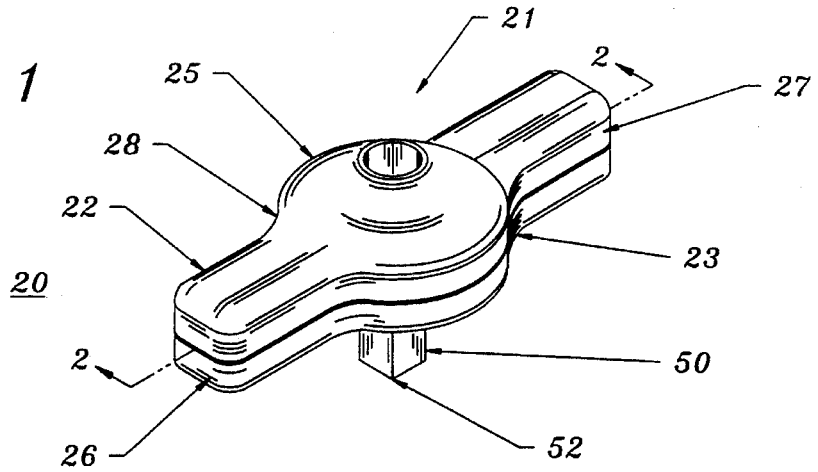
FIG. 1 is a perspective view of a ratchet tool constructed in accordance with a first embodiment of the present invention, and illustrating the shaft in its downward position.

Referring to FIGS. 1–5, there is illustrated a ratchet tool, generally designated by the numeral 20, constructed in accordance with and embodying the features of the first embodiment of the present invention. The ratchet tool 20 has a handle housing 21 formed of a suitable plastic material and including substantially identical housing members 22 and 23 fixedly secured together by a suitable means, such as ultrasonic welding. More specifically, each of the housing members 22 and 23 has a peripheral ridge 24 around the inner face thereof, the housing members 22 and 23 being assembled with their inner faces in back-to-back abutting arrangement so that the housing members 22 and 23 contact only along the peripheral ridges 24. When thus assembled, the handle housing 21 has an enlarged, generally circularly cylindrical hub portion 25 and two generally rectangular wing portions 26 and 27, respectively extending diametrically from opposite sides of the hub portion 25. The housing 21 is shaped to provide convenient gripping surfaces for a user's hand, with the wing portions 26 and 27 being easily grasped by the fingers, and with radiused recesses 28 between the hub portion 25 and the wing portions 26 and 27 for receiving the thumb.

Each of the housing members 22 and 23 has a plurality of cavities formed therein so that, when assembled, the handle housing 21 defines a cavity formation 30 including a cylindrical central cavity 31 in the hub portion 25, generally rectangular wing cavities 32 and 33, respectively, in the wing portions 26 and 27, and circularly cylindrical pin cavities 35 and 36, respectively, disposed at the junctures between the hub portion 25 and the wing portions 26 and 27. The wing cavities 32 and 33 are for lightening purposes to reduce the weight of the tool. The inner faces of the housing members 22 and 23 are spaced apart except at the peripheral ridges 24 so as to define therebetween a narrow passage 34 which provides communication among the several cavities 31–33, 35 and 36. Also respectively formed in the housing members 22 and 23 are circular openings 37 and 38 which communicate with the central cavity 31 coaxially therewith.

Figure 4:
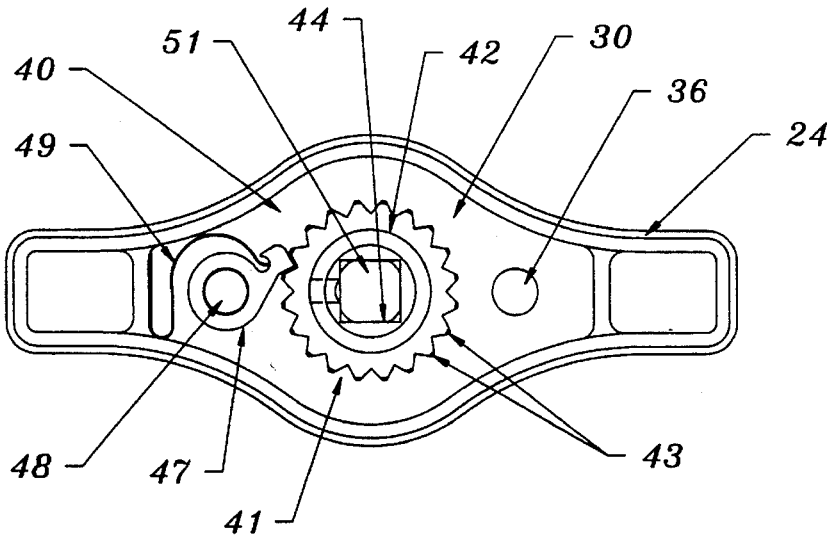
FIG. 4 is a top plan view of the ratchet tool of FIG. 2, with the top housing member removed.
Figure 7:
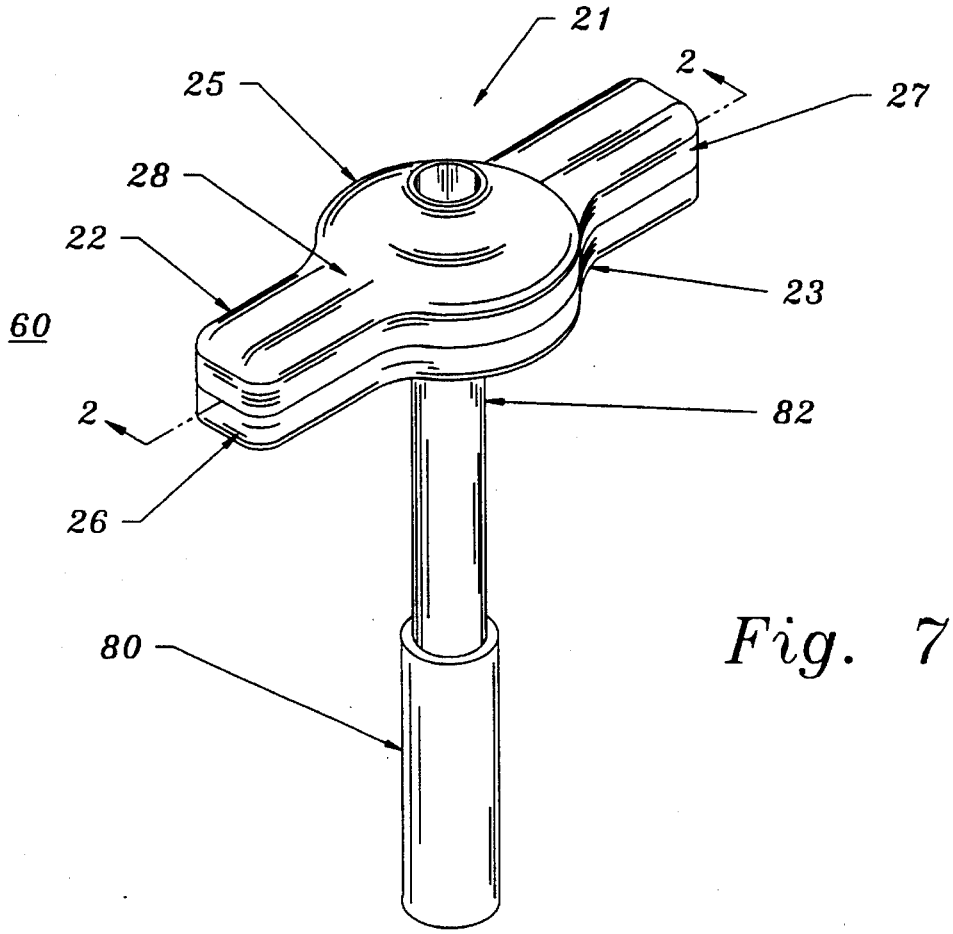
FIG. 7 is a perspective view of a ratchet tool in accordance with a second embodiment of the present invention.

Disposed in the cavity formation 30 is a ratchet mechanism 40, which includes a ratchet wheel 41 having an elongated cylindrical hub 42 disposed coaxially in the central cavity 31. The hub 42 is provided midway between its ends with ratchet teeth 43 which are disposed, in use, in the channel 34. The ratchet wheel 41 has an axial passage 44 therethrough substantially square in transverse cross section, the passage 44 having an enlarged, circularly cylindrical, counterbore portion 45 at the upper end thereof. Also formed radially through the hub 42 adjacent to its lower end is a detent bore 46 communicating with the square passage 44. The ratchet mechanism 40 also includes a pawl 47 which is fixed to a pivot pin 48 which is, in turn, disposed for rotation about its axis in one of the pin cavities 35, the pawl 47 being disposed in use in the channel 34 for pivotal movement between engaged and disengaged positions relative to the ratchet wheel 41, all in a known manner. Preferably, a leaf spring 49 is also disposed in the channel 34 and resiliently biases the pawl 47 to its engaged position, which is best illustrated in FIG. 4. It will be appreciated that the pawl 47 accommodates a ratcheting rotation of the ratchet wheel 41 in a clockwise direction, as viewed in FIG. 4, and prevents rotation of the ratchet wheel 41 in the counterclockwise direction, all in standard fashion. The other pin cavity 36 is provided so that the housing members 22 and 23 will be identical. It need not be used but, if desired, another pivot pin 48 may be disposed therein to provide balanced structural support for the handle housing 21 on both sides of the hub portion 25.

The ratchet tool 20 also includes a shaft 50, which is preferably substantially square in transverse cross section and is dimensioned for mating engagement in the square passage 44 of the ratchet wheel 41. The shaft 50 has flat end faces 51 and 52 and, preferably, has a length somewhat greater than the axial thickness of the hub portion 25 of the handle housing 21. A groove 53 (FIG. 5) is formed in the outer surface of the shaft 50 slightly below its middle, as viewed in FIG. 5, in which is disposed a retaining clip 54. Also disposed in the shaft 50 and projecting laterally from one side thereof are three spaced-apart detent balls, 55, 56 and 57 of standard construction, dimensioned for engagement in the detent bore 46 and in detent recesses in associated driven members.

Figure 5:
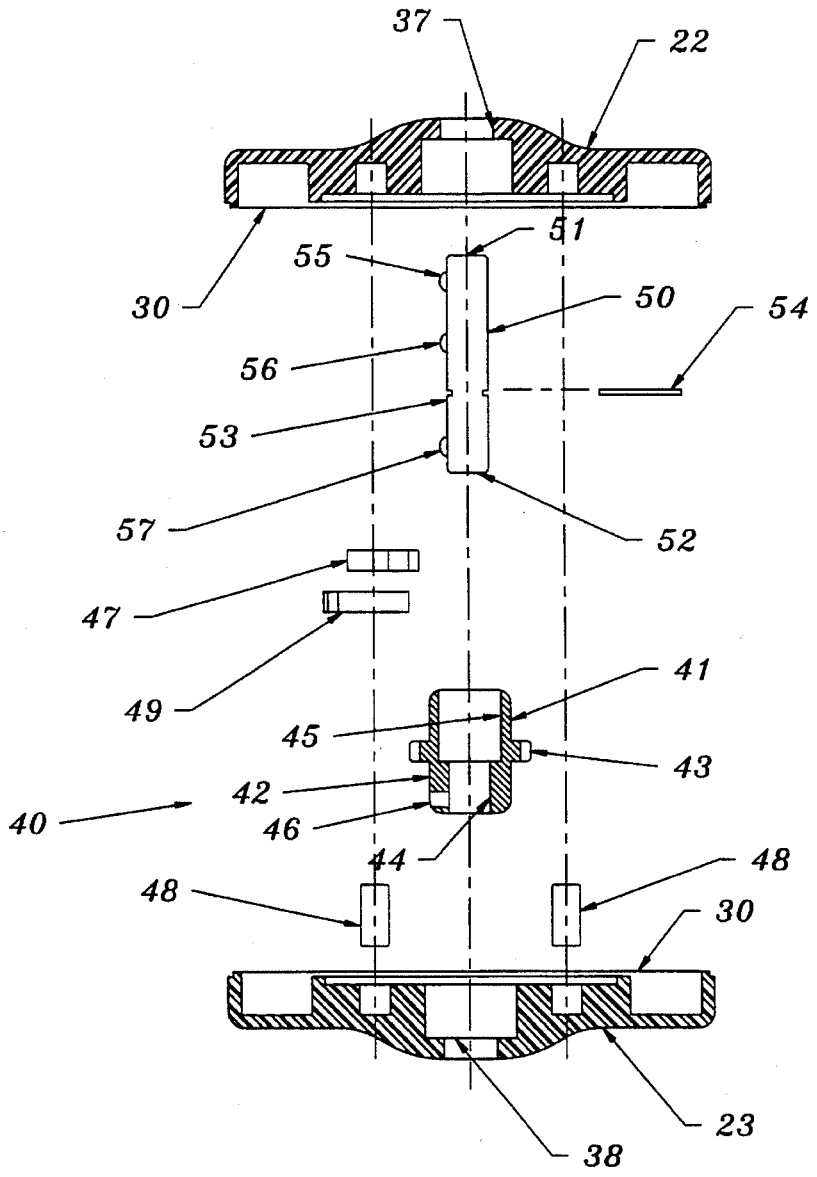
FIG. 5 is an exploded sectional view of the ratchet tool of FIG. 2.
Figure 6:
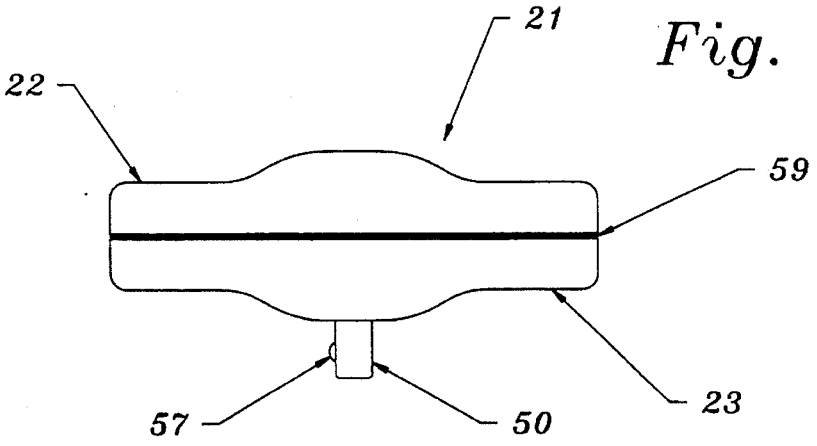
FIG. 6 is a front elevational view of the ratchet tool of FIG. 1.

In assembly, referring to FIG. 5, the shaft 50, with the detent balls 55–57 preassembled therein, is inserted in the square passage 44 through the ratchet wheel 41, and the ratchet wheel 41 is inserted in the central cavity 31 in the lower housing member 23. The pawl 47 is fitted on a pivot pin 48 and that pivot pin is inserted in the pin cavity 35, while another pivot pin 48 is inserted in the other pin cavity 36 in the housing member 23. The leaf spring 49 is then fitted in place to hold the pawl 47 in its engaged position. The upper housing member 22 is then dropped over the assembly, the two housing members 22 and 23 then being fixedly secured together by suitable means so that the shaft 50 extends through one of the openings 37 and 38. Referring to FIG. 6, a preferred form of attachment is by ultrasonic welding at the peripheral ridges 24 of the housing members 22 and 23 to produce a welded seam 59 (FIGS. 2 and 6).

The shaft 50 is dimensioned so that there is a slight clearance between it and the square passage 44, permitting axial sliding movement of the shaft 50 but preventing rotational movement of the shaft 50 relative to the ratchet wheel 41. Thus, it will be appreciated that, if the shaft 50 is engaged with a driven member, rotational movement of the handle housing 21 in a clockwise direction, as viewed in FIGS. 1 and 4, will cause the pawl 47 to effect a corresponding rotational movement of the ratchet wheel 41 and, thereby, the driven member. If the handle housing 21 is rotated in the opposite direction, the pawl 47 will ratchet past the ratchet wheel 41 without rotating it or the shaft 50 and the driven member.

Figure 2:
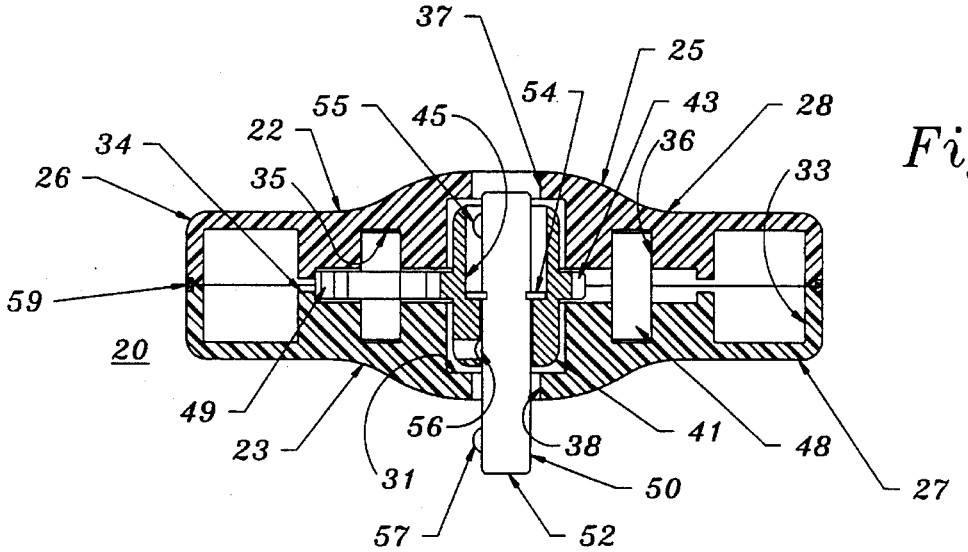
FIG. 2 is a view in vertical section taken along the line 2—2 in FIG. 1.
Figure 3:
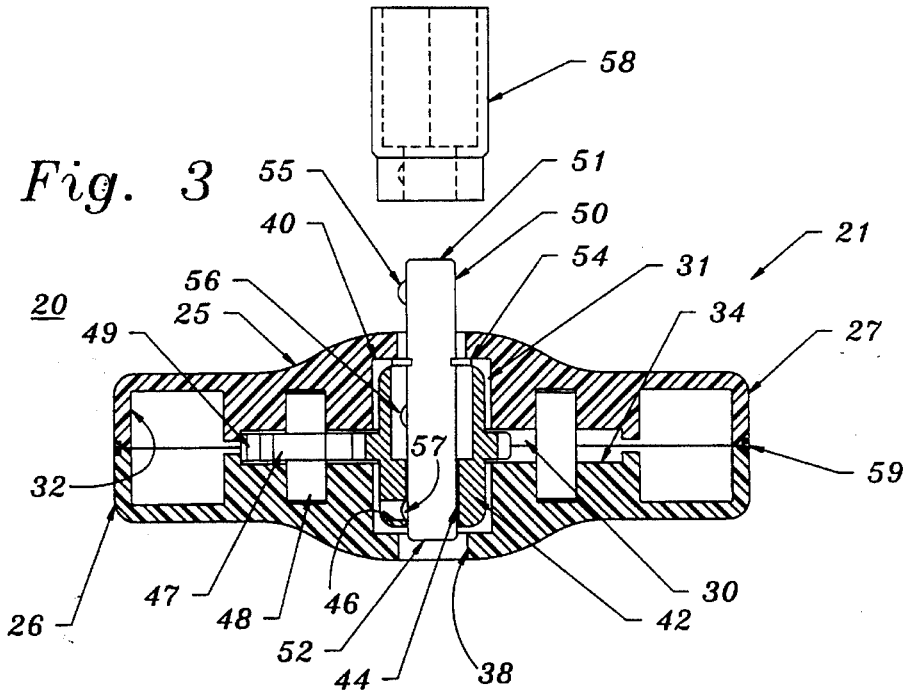
FIG. 3 is a view similar to FIG. 2, and illustrating the shaft in an upward position.

The shaft 50 is axially movable between first and second use positions, respectively illustrated in FIGS. 2 and 3. In the first use position the lower end 52 of the shaft 50 projects downwardly beneath the lower housing member 23 and the middle detent ball 56 is engaged in the detent bore or recess 46 for holding the shaft 50 in place in this use position. In this arrangement, an associated driven member, such as a socket 58, can be fitted on the projecting end of the shaft 50 and retained in place by the detent ball 57, all in a known manner, so that the socket 58 can be manually rotated by the tool 20 in a clockwise direction, as viewed in FIG. 4. When it is desired to rotate the socket 58 in the opposite direction, the shaft 50 is moved upwardly to its second use position, illustrated in FIG. 3. In this position, the detent ball 57 is engaged in the detent bore 46 and the upper end 51 of the shaft 50 projects upwardly beyond the upper housing member 22. The socket 58 can now be mounted on the upper end 51 of the shaft 50, being retained in place by the detent ball 55, to permit a rotation of the socket in the opposite direction. It will be appreciated that the retaining clip 54 limits axial movement of the shaft 50 between its first and second use positions, being engageable with the bottom of the enlarged counterbore portion 45 in the first use position and being engageable with the upper housing member 22 at the end of the central cavity 31 in the second use position.

In the preferred embodiment, the shaft 50 has been illustrated as a square drive shaft. However, it will be appreciated that, if desired, the ratchet tool 20 could be provided with a shaft hexagonal in transverse cross section for engagement with hexagonal recesses in associated driven members, in which case the passage 44 in the ratchet wheel 41 would have a corresponding hexagonal shape.

Referring now to FIGS. 7–10, there is illustrated another ratchet tool, generally designated by the numeral 60, constructed in accordance with another embodiment of the present invention. The ratchet tool 60 has a handle housing 21 substantially identical to that in the ratchet tool 20, described above. Mounted in the handle housing 21 is a ratchet mechanism 70, which differs slightly from the ratchet mechanism 40, described above in connection with FIGS. 1–5. More specifically, the ratchet 70 includes a ratchet wheel 71 which has a circularly cylindrical hub 73 disposed in the central cavity 31 of the handle housing 21, and provided intermediate its ends with a plurality of teeth 74 which are disposed in use in the channel 34 of the handle housing 21. The ratchet mechanism 70 includes a pawl and leaf spring which are substantially identical to those of the ratchet mechanism 40. Formed axially through the ratchet wheel 71 is a passage 75 substantially square in transverse cross section, and having enlarged cylindrical counterbored portions 75*a* at each end thereof. Provided in each of the faces of the passage 75, substantially axially midway between its opposite ends, is a detent recess 76.

The ratchet tool 60 also includes a removable shaft 80, which has a drive socket 81 formed in one end thereof, the socket 81 being polygonal in transverse cross section for mating engagement with an associated driven member 86 (FIG. 8). While the socket 81 may have any desired shape, it is preferably either square or hexagonal in transverse cross section for engaging fasteners or bits, all in a known manner. The shaft 80 has, adjacent to the other end thereof, a reduced-diameter portion 82 dimensioned to fit in the counterbore portion 75*a* of the passage 75. At the end of the portion 82 is a coupling end 83, which is square in transverse cross section and is dimensioned for mating engagement in the passage 75 of the ratchet wheel 71, the coupling end 83 being provided with a detent ball 84 for engagement in one of the detent recesses 76 to hold the shaft 80 in place in the ratchet mechanism 70. It will be appreciated that the shaft 80 cannot rotate relative to the ratchet mechanism 70 but is capable of ratcheting rotation with the ratchet wheel 71. Thus, as was explained above, when the shaft 80 is coupled to a driven member, rotation of the handle housing 21 in a clockwise direction, as viewed in FIG. 9, will effect a corresponding rotation of the driven member, whereas when the handle housing 21 is rotated in the opposite direction it ratchets past the ratchet wheel 71 and does not rotate the shaft or the driven member.

If it is desired to rotate the associated driven member in the opposite direction, the shaft 80 is removed from the bottom of the handle housing 21 and the coupling end 83 is reinserted through the opening 37 in the top of the handling housing 21 and reengaged in the ratchet wheel passage 75.

While, in the embodiment of FIGS. 7–10, the coupling end 83 and the ratchet wheel passage 75 are square in transverse cross section, it will be appreciated that other polygonal shapes could be utilized. There is disclosed in FIG. 11 an arrangement wherein the ratchet mechanism 70 has a ratchet wheel 71A, which is identical to the ratchet wheel 71 except that it has an axial passage 75A therethrough which is hexagonal in transverse cross section. Detent recesses (not shown) may respectively be formed in the several faces of the hexagonal passage 75A. In this case the tool is provided with a shaft 85, shown in FIG. 12, which is similar to the shaft 80, except that it has a coupling end 88 which is hexagonal in transverse cross section for mating engagement in the passage 75A, and is provided with a detent ball 89 engageable in one of the detent recesses.

While the shafts 80 and 85 have been disclosed as retained in place in the ratchet mechanism by means of detent balls and associated detent recesses, it will be appreciated that other retaining means could be used, such as by the use of an O-ring or split wire ring in the ratchet wheel 71, and an associated groove on the shank coupling end 83 or 88, all in a known manner.

From the foregoing, it can be seen that there has been provided an improved ratchet tool which is of simple and economical construction and is characterized by the use of a minimal number of unique parts, including a two-part plastic handle housing which can be interchangeably used with different types of ratchet tool configurations, including a captured-shaft version and a removable shaft version.

I claim:

1. A ratchet tool comprising: an oblong handle housing, a ratchet mechanism disposed in said housing for rotation relative to said housing in only one direction about an axis, said ratchet mechanism having an axial passage polygonal in transverse cross section extending therethrough between opposite ends thereof, said housing having openings therein coaxial with said passage respectively at said opposite ends, ratchet detent structure formed on said ratchet mechanism, a shaft matingly engaged in said passage for rotation with said ratchet mechanism and for axial movement relative to said housing between first and second use conditions, first and second and third shaft detent structures formed on said shaft at longitudinally spaced-apart locations, and retaining means carried by said shaft and engageable with said ratchet mechanism and said handle housing respectively in the first and second use conditions of said shaft for limiting axial movement of said shaft and preventing removal thereof from said passage, said shaft in its first use condition projecting from one of said openings with said first shaft detent structure disposed outwardly of said housing for engagement with an associated driven member and with said second shaft detent structure disposed in engagement with said ratchet detent structure for holding said shaft in its first use condition, said shaft in its second use condition projecting from the other of said openings with said third shaft detent structure disposed outwardly of said housing for engagement with an associated driven member and with said first shaft detent structure disposed in engagement with said ratchet detent structure for holding said shaft in its second use condition.

2. The tool of claim 1, wherein said retaining means includes a groove formed in said shaft and a clip disposed in said groove projecting laterally outwardly from said shaft.

3. A ratchet tool comprising: an oblong handle housing including two substantially identical plastic housing members each having an inner side and an outer side, said housing members being fixedly secured together with their inner sides in abutting mating relationship, said housing members cooperating to define a cavity formation in said handle housing, ratchet mechanism disposed in said cavity formation and including a ratchet wheel rotatable in only one direction relative to said handle housing about an axis extending transversely of said handle housing, said handle housing having two apertures respectively formed in said housing members coaxial with said axis and communicating with said passage, a shaft disposable in said passage and shaped for mating engagement therein for rotation with said ratchet wheel, said shaft being extendable through either of said openings and being axially movable in said passage between first and second use positions relative to said handle housing, and retaining means on said shaft engageable with said ratchet mechanism and said handle housing respectively for limiting axial movement of said shaft and preventing removal of said shaft from said passage.

4. The tool of claim 3, and further comprising first detent structure on said ratchet mechanism and second detent structure on said shaft engageable with said first detent structure for holding said shaft in each of its first and second use positions.

* * * * *